US008584639B2

(12) United States Patent
Elendt et al.

(10) Patent No.: US 8,584,639 B2
(45) Date of Patent: Nov. 19, 2013

(54) VALVE DRIVE OF AN INTERNAL COMBUSTION ENGINE

(75) Inventors: Harald Elendt, Altendorf (DE); Lars Pfutzenreuter, Werdohl (DE); Detlef Axmacher, Iserlohn (DE); Andreas Nendel, Hessdorf (DE); Markus Schnepp, Werdohl (DE); Mathias Boegershausen, Puschendorf (DE); Heiko Schmidt, Muhlhausen (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 218 days.

(21) Appl. No.: 13/139,813

(22) PCT Filed: Feb. 1, 2010

(86) PCT No.: PCT/EP2010/000582

§ 371 (c)(1), (2), (4) Date: Jun. 15, 2011

(87) PCT Pub. No.: WO2010/091798

PCT Pub. Date: Aug. 19, 2010

(65) Prior Publication Data

US 2011/0247577 A1 Oct. 13, 2011

(30) Foreign Application Priority Data

Feb. 14, 2009 (DE) ..... 10 2009 009 080

(51) Int. Cl.
*F01L 1/34* (2006.01)

(52) U.S. Cl.
USPC ..... 123/90.18; 123/90.31; 123/90.6; 29/888.1

(58) Field of Classification Search
USPC ..... 123/90.16, 90.6, 90.18, 90.27, 90.31; 29/888.1
See application file for complete search history.

(56) References Cited

U.S. PATENT DOCUMENTS

| | | | | |
|---|---|---|---|---|
| 6,837,198 | B2 | 1/2005 | Maas et al. | |
| 7,044,094 | B2 | 5/2006 | Bosl-Flierl et al. | |
| 8,186,320 | B2 * | 5/2012 | Schiepp et al. | 123/90.18 |
| 8,191,524 | B2 * | 6/2012 | Elendt et al. | 123/90.6 |

FOREIGN PATENT DOCUMENTS

| | | |
|---|---|---|
| CN | 1471609 | 1/2004 |
| CN | 1732328 | 2/2006 |
| DE | 19611641 | 6/1997 |
| DE | 10148177 | 4/2003 |
| DE | 10148178 | 4/2003 |
| DE | 102007037232 | 2/2009 |
| DE | 102007037747 | 2/2009 |

* cited by examiner

*Primary Examiner* — Ching Chang
(74) *Attorney, Agent, or Firm* — Volpe and Koenig, P.C.

(57) ABSTRACT

A valve drive of an internal combustion engine is provided, having a camshaft (1) which includes a carrier shaft (2) and a cam part (3), which is arranged thereon in a rotationally fixed manner and displaceable between two axial positions and which has at least one cam group of directly adjoining cams (5, 6) having different cam elevations and an axial gate (8) having two cam tracks (9, 10) that extend axially along the circumference in opposing directions, and further having an actuating element (11) that can be coupled to the axial gate for displacing the cam part in the direction of both cam tracks. The cam tracks are arranged one behind the other in the circumferential direction of the axial gate (8).

6 Claims, 2 Drawing Sheets

Fig. 1
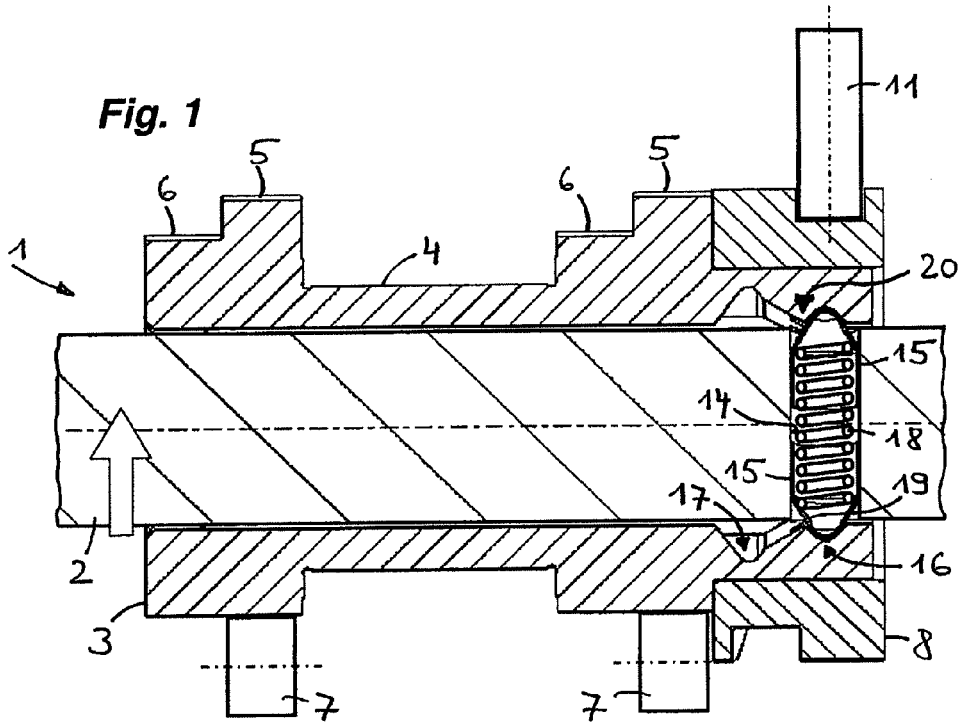
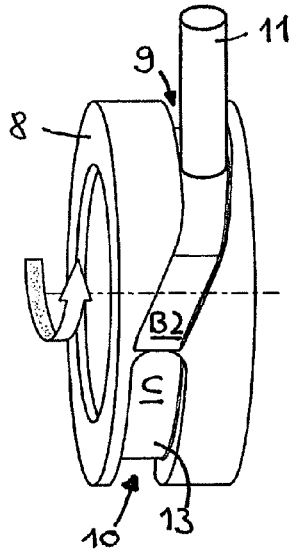
Fig. 2
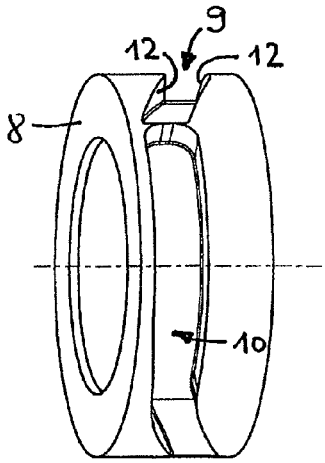
Fig. 3
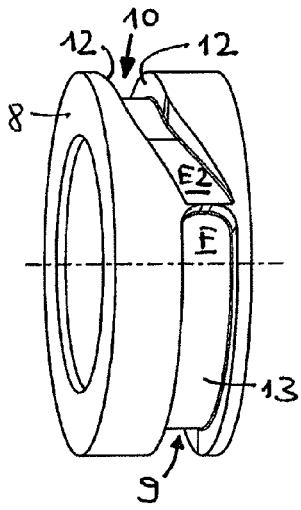
Fig. 4

VALVE DRIVE OF AN INTERNAL COMBUSTION ENGINE

FIELD OF THE INVENTION

The invention relates to a valve drive of an internal combustion engine with a camshaft that comprises a carrier shaft and also a cam part that is locked in rotation on this carrier shaft and is arranged displaceable between two axial positions and has at least one cam group of directly adjacent cams with different cam lifts and an axial connecting link with two curved paths extending opposite each other in the axial direction on its periphery and with an actuation element that can be coupled with the axial connecting link for displacement of the cam part in the direction of the two curved paths.

BACKGROUND

A valve drive of this type that is used for the variable actuation of gas-exchange valves by means of displaceable cams and in which a single actuation element is sufficient for each cam part in order to displace the cam part in the direction of the two curved paths of the axial connecting link is known from DE 101 48 177 A1, which is considered class-forming. In that publication, two cam parts are disclosed with alternatively shaped axial connecting links, wherein the first axial connecting link has a central guide web for forming inner guide walls for the actuation element in the shape of a cylinder pin engaging in the axial connecting link and the second axial connecting link consists of merely outer guide walls.

The latter construction has the advantage that the production effort for the axial connecting link is significantly less due to the elimination of the guide web. In this configuration, however, there is considerable risk with respect to the functional reliability of the valve drive because the displacement process of the cam part is carried out completely, i.e., free from incorrect switching, only when the inertia of the cam part is sufficient to move it into its other end position, to a certain extent in free flight, after passing through the crossing region of the curved paths also without forced action of the cylinder pin. A prerequisite for sufficient inertia of the cam part is obviously a minimum rotational speed of the camshaft that is directly dependent on the friction between the cam part and the carrier shaft. A displacement of the cam part rotating below this minimum rotational speed could have the result that the cam part remains "halfway" and a cam follower acting on the gas-exchange valve is acted upon by several cams of the cam group in an uncontrolled manner and simultaneously under high mechanical loads. In addition, in this case there is no longer a possibility to later displace the cam part using the cylinder pin into one of the end positions, because then the axial allocation between the cylinder pin and the outer guide walls is no longer given.

This functional risk is indeed significantly lower in the first configuration of the axial connecting link with central guide web whose inner guide walls act as the cylinder pin for further accelerating forced guidance at lower rotational speeds of the cam part. Nevertheless, there is also the risk here that the cylinder pin does not merge into the specified curved path after passing through the crossing range, but instead collides with the end of the guide web likewise under a high mechanical load.

SUMMARY

The present invention is therefore based on the objective of further developing a valve drive of the type noted above so that the mentioned functional limitations and risks are at least partially eliminated. Specifically, the objective consists in guaranteeing a successful, i.e., complete switching process of the cam part with the use of a single actuation element for both displacement directions also at low rotational speeds of the camshaft, for example, during the starting process of the internal combustion engine.

The solution of this objective is given from the features of the invention, with advantageous refinements and configurations of the invention being described below. Accordingly, the curved paths should be arranged one behind the other in the circumferential direction of the axial connecting link. One essential difference of the invention with respect to the prior art thus concerns the mutual arrangement of the curved paths on the axial connecting link that now run one behind the other, i.e., in series interconnection, and no longer one next to the other, i.e., in parallel connection, and consequently also no longer cross each other. Through the elimination of the crossing region, the displacement of the cam part is carried out under permanent forced guidance of the axial connecting link relative to the actuation element coupled in this way, so that a complete switching process of the cam part is guaranteed also for the lowest rotational speeds of the camshaft.

While there are various possibilities in the structural configuration with respect to the coupling of the actuation element with the axial connecting link, preferably the curved paths should each be constructed as a groove and the actuation element should be constructed as a cylinder pin engaging in the grooves. Advantageously, the curved paths are each assembled from path sections following one after the other with different axial lifts of the groove walls defining the groove, namely an inlet section without axial lift, a ramp section, and a lift section, wherein the lift section has a significantly larger axial acceleration than the ramp section.

In addition, the cams should have a common root-circle region that begins, at the latest, with the ramp section of the first curved path and ends, at the latest, with the lift section of the second curved path. Because the common root-circle region is to be understood as the angular range of the cam part in which all of the cams of the cam group are free from lift, the displacement of the cam part takes place only when the gas-exchange valve allocated to the cam group is closed and the cam to be brought into engagement during the entire displacement process is likewise located in its root-circle position. Thus, during the displacement process, no valve spring forces increasing the friction between the cam part and carrier shaft act on the cam part. In order to keep the axial acceleration of the cam part as low as possible, the beginning and the end of the root-circle region and of the displacement process are ideally identical.

Furthermore, the lift sections could each be assembled from partial lift sections one following the other with different radial lifts of the groove base defining the groove, namely a first partial lift section without radial lift and a second partial lift section with groove base lifting outward in the radial direction. In contrast to the groove geometry known in the prior art in which the actuation pin is "ejected" from the groove rising in the radial direction into its non-engagement rest position only in the axial force-free state, it is advantageously preferred to superimpose the axial lift and the radial lift of the groove, in order to maximize the available cam angle of the lift sections and consequently to limit the comparatively high axial acceleration in the lift sections to a mechanically controllable level.

In front of the same background, it is finally provided that the second partial lift section and the inlet section border each other directly, wherein the groove base falls away steeply in the radial direction at the transition from the second partial lift section to the inlet section. In particular, for a groove base falling away at a right angle relative to the periphery of the axial connecting link, i.e., for a total angle of the curved paths of 360°, thus the cam angle of the lift sections can be maximized for a given length of the inlet section lying in-between.

BRIEF DESCRIPTION OF THE DRAWINGS

Additional features of the invention are given in the following description and from the drawing in which an embodiment of the invention is illustrated. Shown are:

FIG. 1 a longitudinal section view of a cutout of a valve drive according to the invention;

FIG. 2 a first perspective view X of the axial connecting link according to FIG. 5;

FIG. 3 a second perspective view Y of the axial connecting link according to FIG. 5;

FIG. 4 a third perspective view Z of the axial connecting link according to FIG. 5;

DETAILED DESCRIPTION OF THE PREFERRED EMBODIMENTS

Figure 5:
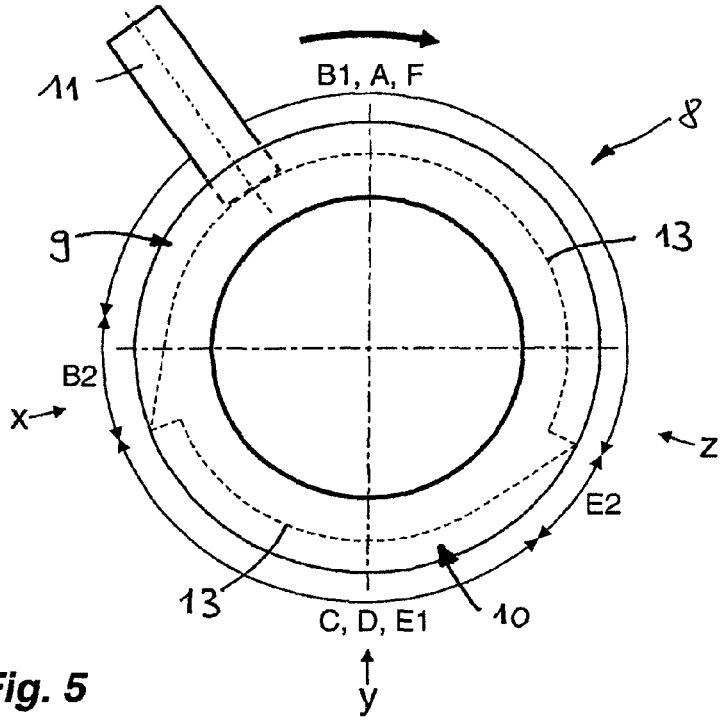
FIG. 5 a side view of the axial connecting link according to FIG. 1 with radial timing diagram, and FIG. 6 a complete lift diagram of the axial connecting link.

In FIG. 1, a cutout of a variable valve drive of an internal combustion engine is shown that is essential for the understanding of the invention. The valve drive has a camshaft 1 that comprises a carrier shaft 2 and also cam parts 3 that are locked in rotation on this carrier shaft—corresponding to the number of cylinders of the internal combustion engine—and are arranged displaceable between two axial positions. For the purpose of axial displacement, the carrier shaft 2 is provided with external, longitudinal teeth and the cam part 3 is provided with corresponding internal, longitudinal teeth. The teeth are known and not shown in detail here.

The cam part 3 has cam groups arranged on both sides of a bearing point 4 each with two cams 5 and 6 that are directly adjacent and have different cam lifts for the same root-circle radius. The displacement of the cam part is realized outside of the cam lifts during the common root-circle region of the cams 5, 6. The cam lifts are each selectively transferred in a known way from a cam follower symbolized here merely by a cam roller 7, such as, e.g., a rocker arm, as a function of the instantaneous axial position of the cam part 3 to a not-shown gas-exchange valve. Different cam lifts are to be understood as different amounts of each cam lift and/or different valve timing of the cams 5, 6.

For switching between the cams 5 and 6, the cam part 3 is provided with an axial connecting link 8 produced as an individual part and joined by an interference fit. On the periphery of the axial connecting link 8, two curved paths 9, 10 that extend opposite each other in the axial direction and are arranged one behind the other in the circumferential direction of the axial connecting link 8 are constructed in the form of grooves in which an actuation element 11 can be coupled. This emerges in detail from FIGS. 2 to 4 in which the axial connecting link 8 is shown from different angular perspectives. The actuation element 11 involves a cylinder pin for such valve drives, with this pin being part of a similarly known actuator that is not explained in detail. The cylinder pin 11 is arranged fixed in position in the axial direction with respect to the camshaft 1, but displaceable in the internal combustion engine in the radial direction and is used for displacement of the cam part 3 in the direction of the two curved paths 9, 10.

The shape of the curved paths 9, 10 is given from an overview of FIGS. 2 to 6. The views shown in FIGS. 2 to 4 of the axial connecting link 8 correspond with the viewing arrows x, y and z, respectively, in FIG. 5 in which the axial connecting link 8 shown in side view is also provided with a radial timing diagram for curved paths 9, 10 according to the dashed line. The arrows shown in FIGS. 1, 2 and 5 designate the rotational direction of the camshaft 1. A complete lift diagram with the radial and axial lift of the curved paths 9, 10 as a function of the camshaft angle is given from FIG. 6.

The two curved paths 9, 10 are each assembled from path sections one following the other with different axial lifts (continuous line in FIG. 6) of the groove walls 12 defining the groove. These path sections involve an inlet section F and C, respectively, without axial lift, a ramp section A and D, respectively, for compensation of axial position tolerances of the cylinder pin 11 relative to the groove walls 12, and a lift section B and E, respectively, wherein the axial acceleration of the lift sections B, E is significantly larger than that of the ramp sections A, D. In the shown embodiment, the common root-circle region of the cams 5, 6 is identical with the path sections A to E, i.e., the common root-circle region begins with the ramp section A of the first curved path 9 and ends with the lift section E of the second curved path 10. Accordingly, the cam lifts of the cams 5, 6 lie in the region of the inlet section F.

Figure 6:
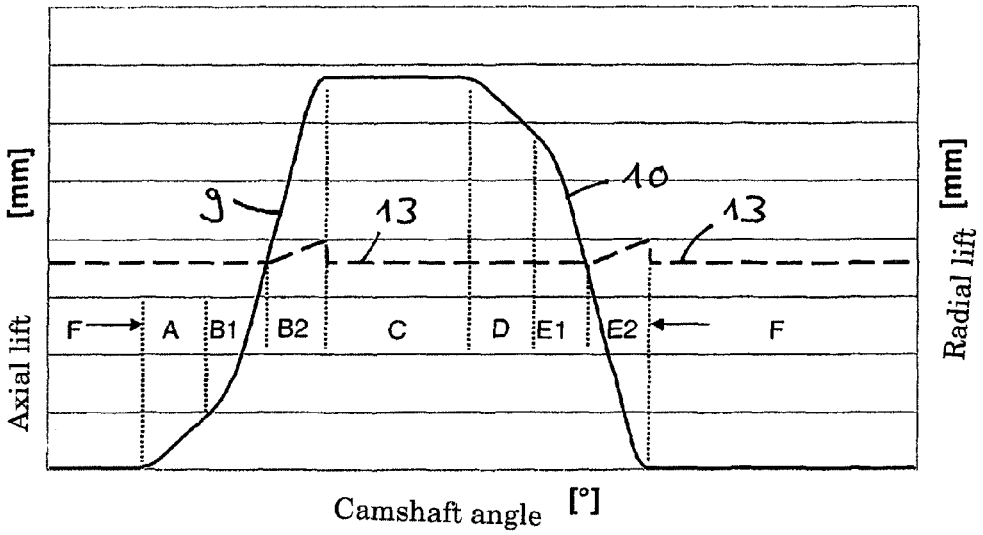

The lift sections B and E are each assembled from partial lift sections B1 and B2 and E1 and E2, respectively, one following the other, differing in the radial lift of the groove base 13 (dashed line in FIGS. 5 and 6). Here, the first partial lift sections B1 and E1 have a groove base 13 with constant depths identical to the sections F and A and C and D, respectively, while the groove base 13 lifts outward in the radial direction past the second partial lift sections B2 and E2, in order to eject the cylinder pin 11 already during the displacement process of the cam part 3 from each groove into its non-engaged rest position.

The switching of the cam part 3 along the first curved path 9, i.e., from the instantaneously effective cam 5 to the cam 6 (see FIG. 1) is realized in that the cylinder pin 11 engages in the inlet section F—according to the size and duration of the cam lift this is already realized during the opened gas-exchange valve—and then passes through the ramp section A and also the lift section B, while the rotating cam part 3 supported on the cylinder pin 11 is shifted into its second axial position. In the course of the second partial lift section B2, the cylinder pin 11 is already lifted by the groove base 13 rising in the radial direction and is completely ejected from the curved path 9 into its non-engaged rest position at the end of the displacement process.

Analogously, the retraction of the cam part 3 along the second curved path 10, i.e., from the then active cam 6 to the cam 5, is carried out in that the cylinder pin 11 engages in the inlet section C and then passes through the ramp section D and also the lift section E, while the rotating cam part 3 supported on the cylinder pin 11 is shifted back into its first axial position. Here, the cylinder pin 11 is also lifted in the course of the second partial lift section E2 by the groove base 13 rising in the radial direction and is completely ejected from the curved path 10 into its non-engaged rest position at the end of the displacement process.

As becomes clear from FIGS. 2 to 5, the second partial lift sections B2 and E2 and the inlet sections C and F, respectively, border one on the other directly, wherein the groove base 13 falls away at a right angle in the radial direction at the transition of these sections, in order to maximize, above all, the length of the lift section B for a specified length of the inlet section C.

The catch device shown in FIG. 1 is used for fixing the cam part 3 in its axial positions relative to the carrier shaft 2. The catch device comprises two diametrically opposite catch bodies 15 supported displaceable in a radial drilled hole 14 of the carrier shaft 2 formed as a through hole and catch grooves 16 and 17 that extend on the inner periphery of the cam part 3 and are constructed as circumferential grooves and in which the catch bodies 15 loaded by a spring 18 in the outward radial direction are each locked in the associated axial positions.

The catch bodies 15 involve thin-walled, shaped sheet-metal parts that are open on one side. Its open side is constructed as the hollow cylinder that surrounds the spring 18 constructed as a coil compression spring and supported in the radial drilled hole 14, while the following closed side involves a hollow body that tapers in the direction of the catch grooves 16, 17 and initially has a conical shape and a spherical shape at the end. In order to guarantee a low-resistance inlet of the catch body 15 into the radial drilled hole 14 during the displacement process of the cam part 3, the catch bodies 15 are provided with a pressure-release opening 19 in the conical-shaped region of the hollow body.

The function of the catch device is limited not only to the fixing of the cam part 3 in the two axial positions, but also comprises a braking of the cam part 3 in its axial movement at the end of the partial lift sections B2 and E2. This braking is generated by contact friction of the spring-loaded catch bodies 15 on the groove walls of the catch grooves 16, 17 running adjacent in the axial direction on both sides of the peak 20. Shown differently than in FIG. 1, it is advantageous when the catch grooves 16, 17 have geometrically identical constructions and the peak 20 runs in the center—with respect to the distance of the axial positions of the cam part 3 belonging to the catch grooves 16, 17.

REFERENCE SYMBOLS

1 Camshaft
2 Carrier shaft
3 Cam part
4 Bearing point
5 Cam
6 Cam
7 Cam roller
8 Axial connecting link
9 First curved path
10 Second curved path
11 Actuation element/cylinder pin
12 Groove wall
13 Groove base
14 Radial drilled hole
15 Catch body
16 Catch groove
17 Catch groove
18 Spring/coil compression spring
19 Pressure-release opening
20 Peak of catch grooves
A Ramp section
B1,2 Lift section
C Inlet section
D Ramp section
E1,2 Lift section
F Inlet section

The invention claimed is:

1. Valve drive of an internal combustion engine comprising a camshaft that includes a carrier shaft and a cam part that is locked in rotation on the carrier shaft and is arranged displaceable between two axial positions and has at least one cam group of directly adjacent cams with different cam lifts and an axial connecting link with non-circumferentially overlapping first and second curved paths extending opposite each other in the axial direction on a periphery thereof and with an actuation element that can be coupled with the axial connecting link for displacement of the cam part in a direction of the non-circumferentially overlapping first and second curved paths, and the non-circumferentially overlapping first and second curved paths are arranged one behind the other in a circumferential direction of the axial connecting link.

2. Valve drive according to claim 1, wherein the non-circumferentially overlapping first and second curved paths are each constructed as grooves and the actuation element is constructed as a pin engaging in the grooves.

3. Valve drive according to claim 2, wherein the non-circumferentially overlapping first and second curved paths are each assembled from path sections one following the other with different axial lifts of the groove walls defining the groove, including an inlet section without axial lift, a ramp section and a lift section, wherein the lift section has a significantly larger axial acceleration than the ramp section.

4. Valve drive according to claim 3, wherein the cams have a common root-circle region that begins, at the latest, with the ramp section of the first curved path and ends, at the earliest, with the lift section of the second curved path.

5. Valve drive according to claim 3, wherein the lift sections are each assembled from partial lift sections one following the other with different radial lifts of a groove base defining the groove, including a first partial lift section without radial lift and a second partial lift section with the groove base rising outward in the radial direction.

6. Valve drive according to claim 5, each of the second partial lift sections and the inlet sections directly border each other, wherein the groove base falls away steeply in the radial direction at a transition from the second partial lift sections to the inlet sections with respect to the periphery of the axial connecting link.

* * * * *